US005100087A

United States Patent [19]

Ashby

[11] Patent Number: 5,100,087

[45] Date of Patent: Mar. 31, 1992

[54] FASTENING DEVICE FOR CONTAINER LINERS

[76] Inventor: Stephen B. Ashby, 586 N. Dielman, St. Louis, Mo. 63132

[21] Appl. No.: 542,815

[22] Filed: Jun. 25, 1990

Related U.S. Application Data

[63] Continuation of Ser. No. 319,044, Mar. 6, 1989, abandoned, which is a continuation of Ser. No. 141,546, Jan. 7, 1988, abandoned.

[51] Int. Cl.[5] ..... B65B 67/00

[52] U.S. Cl. ..... 248/97; 220/404; 248/99

[58] Field of Search ..... 248/95, 98, 97, 99, 248/100, 101; 220/403, 404

[56] References Cited

U.S. PATENT DOCUMENTS

| | | | |
|---|---|---|---|
| 4,027,774 | 6/1977 | Cote | 248/99 X |
| 4,437,634 | 3/1984 | Hambleton | 248/97 |
| 4,445,658 | 5/1984 | Ferron | 248/99 |
| 4,457,483 | 7/1984 | Gagne | 248/97 |
| 4,509,570 | 4/1985 | Eby et al. | 248/97 X |
| 4,535,911 | 8/1985 | Goulter | 220/404 |
| 4,576,310 | 3/1986 | Isgar et al. | 220/404 |
| 4,620,683 | 11/1986 | Claydon et al. | 248/97 |
| 4,638,968 | 1/1987 | Auten | 248/97 |
| 4,664,347 | 5/1987 | Brown et al. | 248/97 |
| 4,690,357 | 9/1987 | Webster | 248/99 |
| 4,735,340 | 4/1988 | Preston | 220/404 |
| 4,760,983 | 8/1988 | McNerney | 248/100 |
| 4,763,808 | 8/1988 | Guhl et al. | 248/100 X |
| 4,957,252 | 9/1990 | Watkins | 248/99 X |

*Primary Examiner*—David L. Talbott
*Attorney, Agent, or Firm*—Heller & Kepler

[57] ABSTRACT

A device for securing a plastic bag with handles in a container comprising a vertical row of fastening devices located on an external side of the container. The devices fasten one handle of the plastic bag to the side of the container such that the mouth of the bag is pulled tight against the opposite side of the container and thus held in place around the rim of the container.

8 Claims, 5 Drawing Sheets

FASTENING DEVICE FOR CONTAINER LINERS

CROSS-REFERENCE TO RELATED APPLICATIONS

This application is a continuation of application Ser. No. 07/319,044, filed Mar. 6, 1989, now abandoned, which was a continuation of Ser. No. 07/141,546 filed Jan. 7, 1988, now abandoned.

BACKGROUND—FIELD OF INVENTION

This invention relates to trash containers which may be lined with plastic bags, in particular plastic bags with handles.

BACKGROUND—DESCRIPTION OF PRIOR ART

Many consumers prefer to line their trash containers with the bags they bring home their purchases in. In recent years, stores have switched from paper bags to limp, non-supporting plastic bags with handles. These bags have a tendency to slip off the rim of the trash container and fall closed in the bottom.

Many efforts have been made to support these bags in an open manner to facilitate their use for trash disposal. In Isgar (U.S. Pat. No. 4,576,310) there is disclosed a container with two sets of cooperating hooks and notches. One problem associated with Isgar is that the bag is held across the mouth of the container instead of around the rim, allowing trash to fall down between the wall of the container and the bag. Isgar is also suited for use with only one size of handled plastic bag. Ferron (U.S. Pat. No. 4,445,658) discloses a fixed rim with downwardly protruding rods. Ferron is also suited for use with only one size of plastic bag with handles.

OBJECTS AND ADVANTAGES

One main object, therefore, of the present invention is to provide a device which will secure plastic bags with handles in place around the rim of a trash container and facilitate the use of plastic bags of different sizes. Further objects and advantages will become apparent from a consideration of the ensuing description and accompanying drawings.

Another object of the present invention is to provide a device which will hold open the mouth of a handled plastic bag to facilitate its being filled with a product.

DRAWING FIGURES

DRAWING REFERENCE NUMERALS

Figure 1:
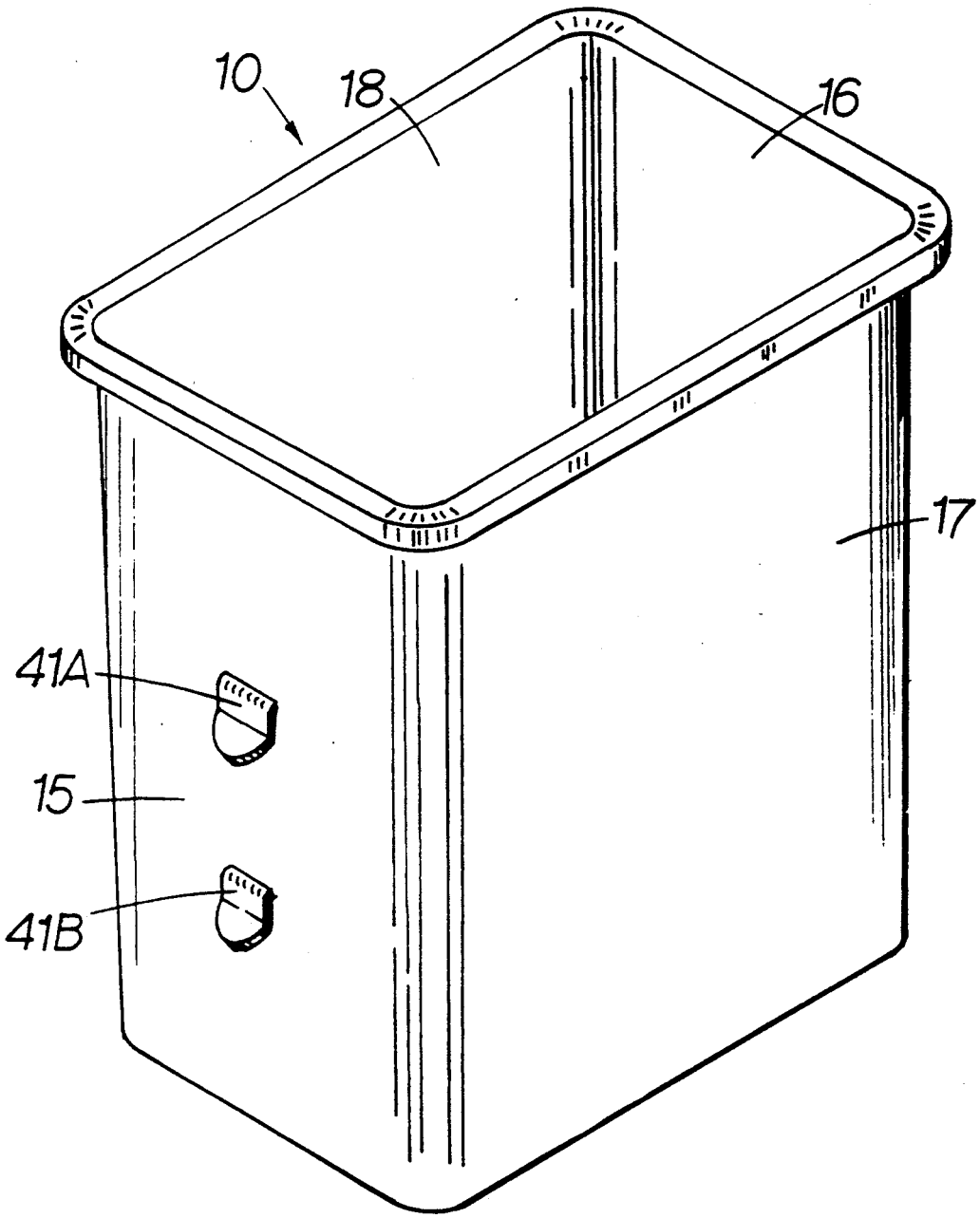
FIG. 1 shows a perspective back elevational view of a trash container manufactured with the fastening device.

7 Bag filling stands
10 trash container
15 short container side
16 short container side
17 long container side
18 long container side
41 fastening device
43 parallel section of fastening device
44 nubbin underneath parallel section
45 angled section of fastening device
50 plastic bag with handles
51 bag handle

Fastening Device—Description

Figure 2:
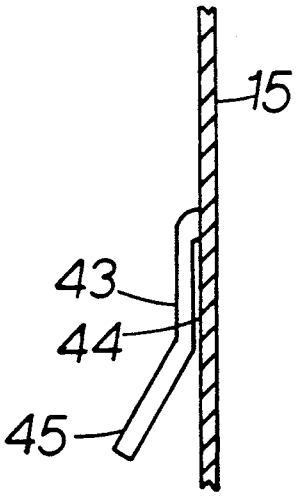
FIG. 2 shows a side view of the preferred embodiment of the fastening device.
Figure 3:
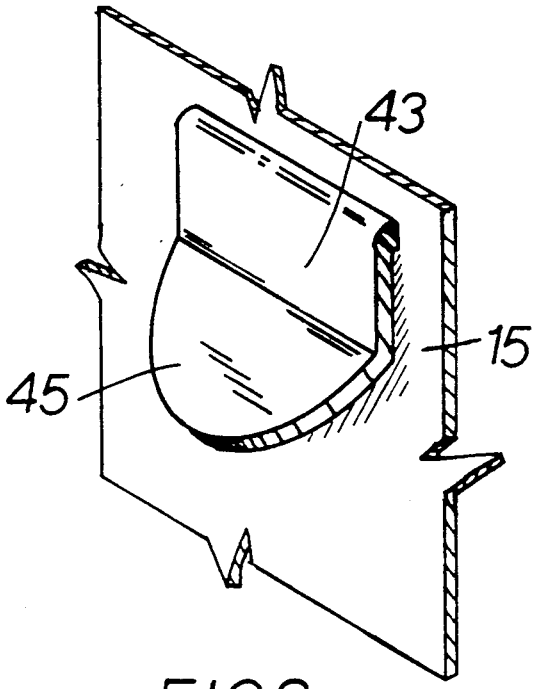
FIG. 3 shows a perspective view of the preferred embodiment of the fastening device.

FIG. 1 shows a trash container 10 manufactured with the fastening device. The trash container is of rectangular shape, having two short sides, 15, 16, and two long sides, 17 and 18. Molded onto the exterior of side 15 are a series of fastening devices 41*a* 41*b*. As best shown in FIG. 2 and 3 the fastening device extends downward, having a part 43 which is closely situated to and parallel to the container wall, and a lower part 45 which angels away from the container wall. Situated on the underneath of the parallel part 43 is a nubbin 44 which comes in contact with the container wall.

Securing Device—Operation

Figure 4:
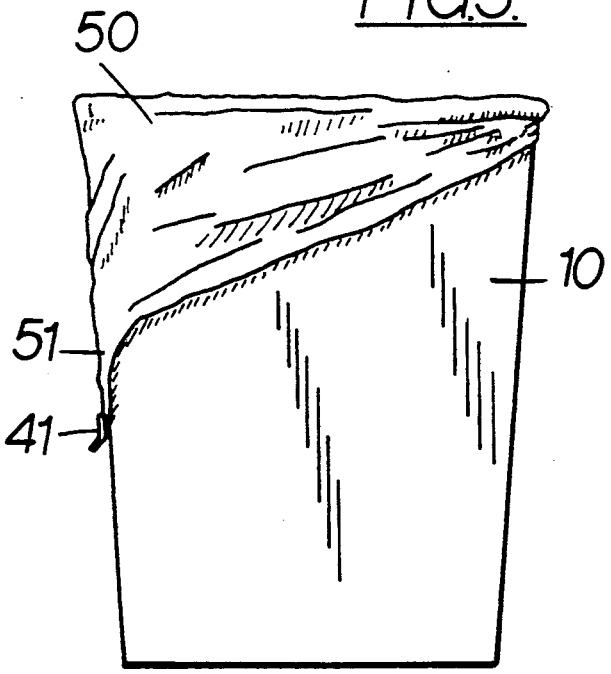
FIG. 4 shows a side view of a trash container manufactured with a single fastening device lined with a handled plastic bag.

In the preferred embodiment of the invention, shown in FIG. 4, the body of plastic bag 50 is inserted into container 10, which is manufactured with a fastening device on one side. The mouth of the bag is then pulled out over the rim of the container. One bag handle 51 is grasped and pulled downward until the other side of the bag is pulled tight against the rim of the container. The bag handle 51 is then placed in the fastening device 41 and pulled upwards until it rests in the crook of the fastening device. The bag handle forces the tab of the fastener away from the side of the container, the resulting tension working with the nubbin to hold the bag handle in place. Thus the bag handle is actively fastened to the side of the container and the mouth of the bag is held in place around the container rim.

Figure 5:
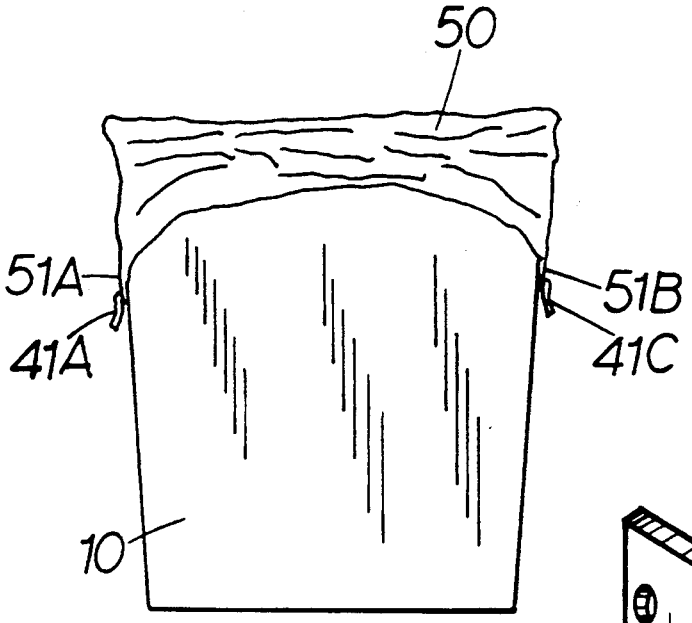
FIG. 5 shows a side view of a trash container manufactured with fastening devices on both sides lined with a handled plastic bag.
Figure 6:
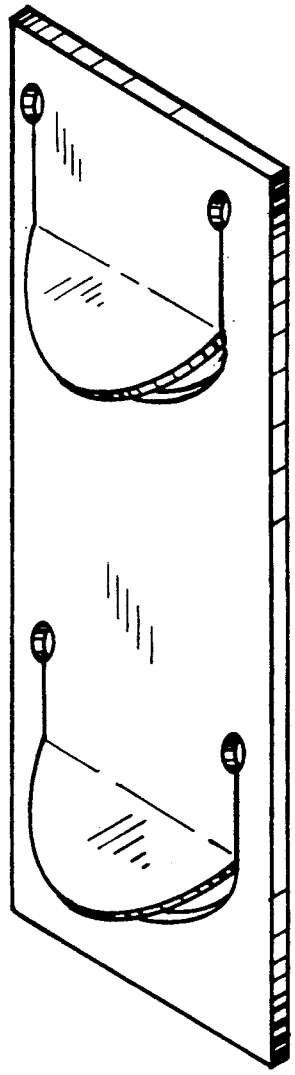
FIG. 6 shows a perspective view of a fastening device which may be added to existing containers.
Figure 7:
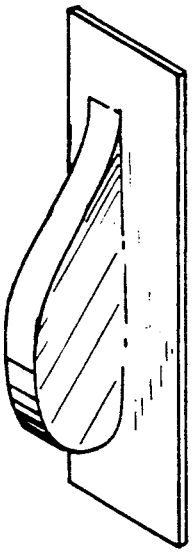
FIG. 7 shows a perspective view of an embodiment of the fastening device comprising a flat tab with a downwardly facing opening.
Figure 8:
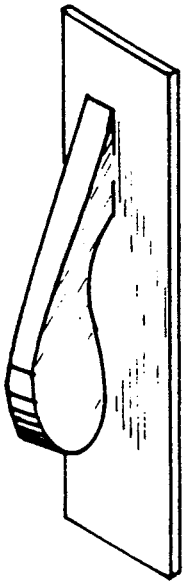
FIG. 8 shows a perspective view of a fastening device comprising a clip-like projection.
Figure 9:
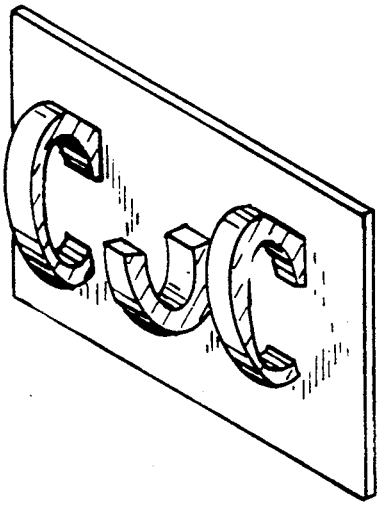
FIG. 9 shows a perspective view of an additional embodiment of the fastening device comprising three incurvate tabs.
Figure 10:
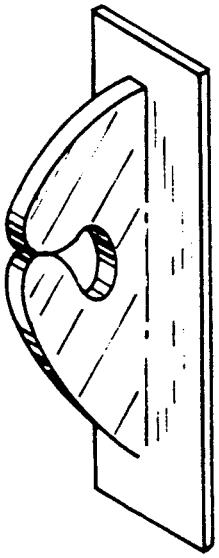
FIG. 10 shows a perspective view of a fastening device comprising a tab with a pincher-like opening.
Figure 11:
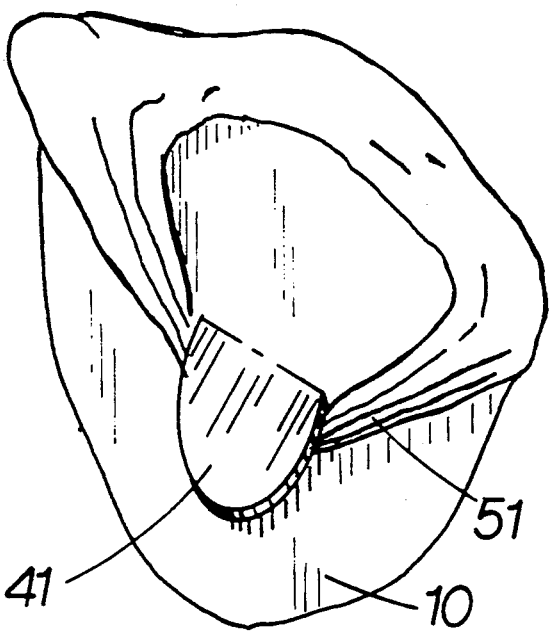
FIG. 11 shows a closeup of a bag handle secured by a fastener of the present invention.
Figure 12:
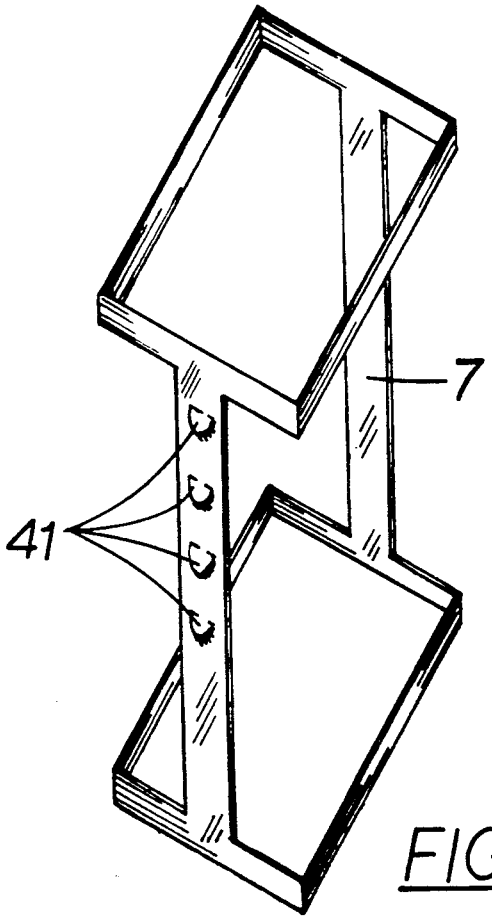
FIG. 12 shows a perspective view of a bag filling stand incorporating the fastening device.

In another preferred embodiment of the invention, shown in FIG. 5, the body of plastic bag 50 is inserted in container 10, which is manufactured with two fastening devices 41*a* 41*c* on opposite sides of the container. The bag handles 51*a* 51*b* are then grasped and pulled downward until the mouth of the bag is pulled out over the rim of the container. The bag handles are then placed in the fastening devices and pulled upward until they rest in the crook of the fastening device. The bag handles force the tabs away from the sides of the container, the resulting tension working with the nubbin to hold the bag handle in place. In this manner the bag handles are fastened to the sides of the container and the mouth of the bag is held in place around the rim of the container.

In another preferred embodiment of the invention a bag filling stand 7 may be provided in the shape illustrated or other suitable shapes, and also have but a single fastener. It will be understood that the bag filling stand may also be used in conjunction with a scale (not shown) to allow a product to be weighed as it is placed in the bag.

While the above contains many specificities, the reader should not construe these as limitations on the scope of the invention, but merely as exemplifications of preferred embodiments thereof. Those skilled in the art will envision many other variations within its scope. For example skilled artisans will readily be able to make the fastening devices from difference materials, such as plastic or metal. The fasteners may be made in any shape, or can even be recessed into the side of the container. The drawings show a rectangular trash container, but the fastening devices will work on containers of any shape, such as round or square, and containers to be used for any purpose. The fastening devices may be used on a bag filling stand, which may be used in conjunction with a scale to allow the contents of the bag to be weighed. The add on fastening devices may comprise a single fastening device, or more than two, and may be made in different shapes, such as with a rounded back for use with round containers, and may be attached to the containers in a variety of methods. Accordingly the reader is requested to determine the scope of then invention by the appended claims and their legal equivalent, and not by the examples which have been given.

We claim:

1. A device for securing a plastic bag with handles in a container for use as a liner of the container comprising:

a container having generally upright side portions and the side portions terminating in a substantially continuous rim portion;

a means for gripping a handle of a plastic gag with handles to an external side of the container, the gripping means situated a sufficient distance from the rim of the container so as to work in cooperative association with the opposite external side of the container so as to increase the effective circumference of the mouth of the container, whereby the mouth of the plastic bag with handles is pulled against the opposite external side of the container, holding the mouth of the plastic bag around the rim of the container in an open manner and in operative cooperation with the internal facing surface and the rim portion to substantially prevent the development of a gap between the handled bag and the internal facing rim portion of the container.

2. The device of claim 1 wherein the gripping means comprises a plurality of spaced apart gripping members to accommodate handles of different sized plastic bags.

3. The device of claim 1 wherein the gripping means is provided during the original manufacture of the container.

4. The device of claim 1 wherein the fastening means may be added to the container at time of manufacture so as to be integral with the container.

5. A device for securing a plastic bag with handles in a container for use as a liner of the container comprising:

a container having generally upright side portions and the side portions terminate in a substantially continuous rim portion;

a gripping means for positively fastening the handles of a plastic bag with a plurality of handles to the opposite external sides of the container, the gripping means situated a sufficient distance from the rim of the container so as to work in cooperative association to increase the effective circumference of the mouth of the container, whereby the mouth of the plastic bag with handles is held in place around the rim of the container in an open manner and in operative cooperation with the internal facing surface and the rim portion of the container so as to substantially prevent the development of a gap between the handled bag and the internal facing and rim portion of the container.

6. The device of claim 5 wherein the gripping means comprises a plurality of gripping devices to facilitate the use of different size plastic bags with handles.

7. The device of claim 5 wherein the gripping means is of original manufacture to the container.

8. The device of claim 5 wherein the gripping means is added to the container at time of manufacture so as to be integral with the container.

* * * * *